US009624027B2

(12) United States Patent
DeGraaf

(10) Patent No.: US 9,624,027 B2
(45) Date of Patent: Apr. 18, 2017

(54) PERSONAL PROTECTION EQUIPMENT DISPENSERS

(71) Applicant: Bowman Manufacturing Company, Inc., Arlington, WA (US)

(72) Inventor: Danté G. DeGraaf, Lake Stevens, WA (US)

(73) Assignee: Bowman Manufacturing Company, Inc., Arlington, WA (US)

( * ) Notice: Subject to any disclaimer, the term of this patent is extended or adjusted under 35 U.S.C. 154(b) by 0 days.

(21) Appl. No.: 14/288,105

(22) Filed: May 27, 2014

(65) Prior Publication Data

US 2014/0361024 A1 Dec. 11, 2014

Related U.S. Application Data

(60) Provisional application No. 61/832,099, filed on Jun. 6, 2013.

(51) Int. Cl.
*B65D 83/08* (2006.01)

(52) U.S. Cl.
CPC ..... *B65D 83/0817* (2013.01)

(58) Field of Classification Search
CPC .. A61B 19/045; A61B 19/0256; A47K 10/185
USPC ..... 220/737
See application file for complete search history.

(56) References Cited

U.S. PATENT DOCUMENTS 2,911,175 A * 11/1959 Erie ..... A47K 10/185 221/46
5,950,382 A * 9/1999 Martino ..... B44C 5/0446 52/311.1
6,651,827 B1 * 11/2003 Eberwein ..... A47F 7/141 206/215
6,820,753 B2 * 11/2004 Kurtz ..... A47K 10/20 211/49.1
7,004,435 B2 * 2/2006 Formon ..... A47K 10/185 206/233

* cited by examiner

*Primary Examiner* — Shawn M Braden
(74) *Attorney, Agent, or Firm* — Schacht Law Office, Inc.; Michael R. Schacht

(57) ABSTRACT

The present invention generally relates to dispensers for holding a consumables box containing consumable products such as, but not limited to, disposable latex gloves. In one embodiment, the dispenser includes a continuous front plate with an aperture for extracting the consumable products, continuous side plates, and separable back plates that develop a load path with the continuous front plate after the dispenser has been mounted onto a mounting surface. The dispenser may include one or more spring mechanisms that urge the consumables box into a forward and centered position within the dispenser. The continuous front plate resists undesired deflection when subjected to an outward force. In another embodiment, one or more surfaces of the dispenser may be overlaid with a woodgrain laminate for aesthetic purposes.

18 Claims, 5 Drawing Sheets

PERSONAL PROTECTION EQUIPMENT DISPENSERS

PRIORITY CLAIM

The present application claims the benefit of the filing date of U.S. Provisional Patent Application No. 61/832,099, filed on Jun. 6, 2013 and which is incorporated herein by reference in its entirety.

FIELD OF THE INVENTION

The present invention generally relates to personal protection equipment (PPE) dispensers for organizing and dispensing consumable goods such as, but not limited to, gloves, facemasks, gowns, wipes, and pads for industries such as, but not limited to, medical, healthcare, education, foodservice, automotive, and industrial.

BACKGROUND

FIG. 1 shows a conventional dispenser 10 that takes the form of a spring loaded dispenser produced from a single sheet of material. The conventional dispenser 10 includes a spring mechanism 12 in the form of an angled flange configured to urge a consumables box (not shown) forward so the consumable products may be withdrawn from an aperture 14 in the conventional dispenser 10 and a corresponding aperture (not shown) in the box.

The conventional dispenser 10 is typically made from a single piece of material (e.g., non-finished plastic, powder coated metals, and stainless steel). The conventional dispenser 10 includes a top edge 16 and a bottom edge 18. A back plate 20 takes the form of a continuous back plate. The side plates 22 take the form of continuous side plates integrally formed with the continuous back plate 20. The front plates 24, 26 are bent relative to the continuous side plates 22, but the front plates 24, 26 not connected, which in turn permits the aperture 14 to extend openly from the top edge 16 of the dispenser to the bottom edge 18 of the dispenser. A bottom shelf 28 extends from the back plate 20 to support the consumables box (not shown).

SUMMARY

The present invention generally relates to dispensers for holding a consumables box containing consumable products such as, but not limited to, disposable latex gloves. In one embodiment, the dispenser includes a continuous front plate with an aperture for extracting the consumable products, continuous side plates, and separable back plates that develop a load path with the continuous front plate after the dispenser has been mounted onto a mounting surface. The dispenser may include one or more spring mechanisms that urge the consumables box into a forward and centered position within the dispenser. The continuous front plate resists undesired deflection when subjected to an outward force. In another embodiment, one or more surfaces of the dispenser may be overlaid with a woodgrain laminate for aesthetic purposes.

In one aspect of the present invention, a dispenser includes a plurality of bottom shelves configured to support a consumables box containing consumable products; a continuous front plate having an aperture configured to extract the consumable products from the consumables box; continuous side plates integrally formed with the continuous front plate; and back plates separable by a cut, the back plates integrally formed with the continuous side plates. Further, the dispenser, when mounted to a mounting surface, permits one or more outward forces applied to the continuous front plate to be transmitted to the mounting surface without causing an undesirable amount of displacement of the continuous front plate.

In another aspect of the present invention, a forming method for a dispenser includes the steps of (1) obtaining a single sheet of material; (2) cutting an aperture into a continuous front plate of the material; (3) bending the material to form continuous side plates; (4) bending the material to form back plates separable by abuttable free edges of the single sheet of material; and (5) bending the continuous front plate, the continuous side plate and the back plates to form a bottom shelf configured to support a consumables box.

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility. Preferred and alternative embodiments of the present invention are described in detail below with reference to the following drawings.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with dispensers and organizers for consumable goods, assemblies and subassemblies of the same, and methods of using, assembling and installing any of the above have not necessarily been shown or described in detail to avoid unnecessarily obscuring descriptions of the embodiments of the invention.

Figure 1:
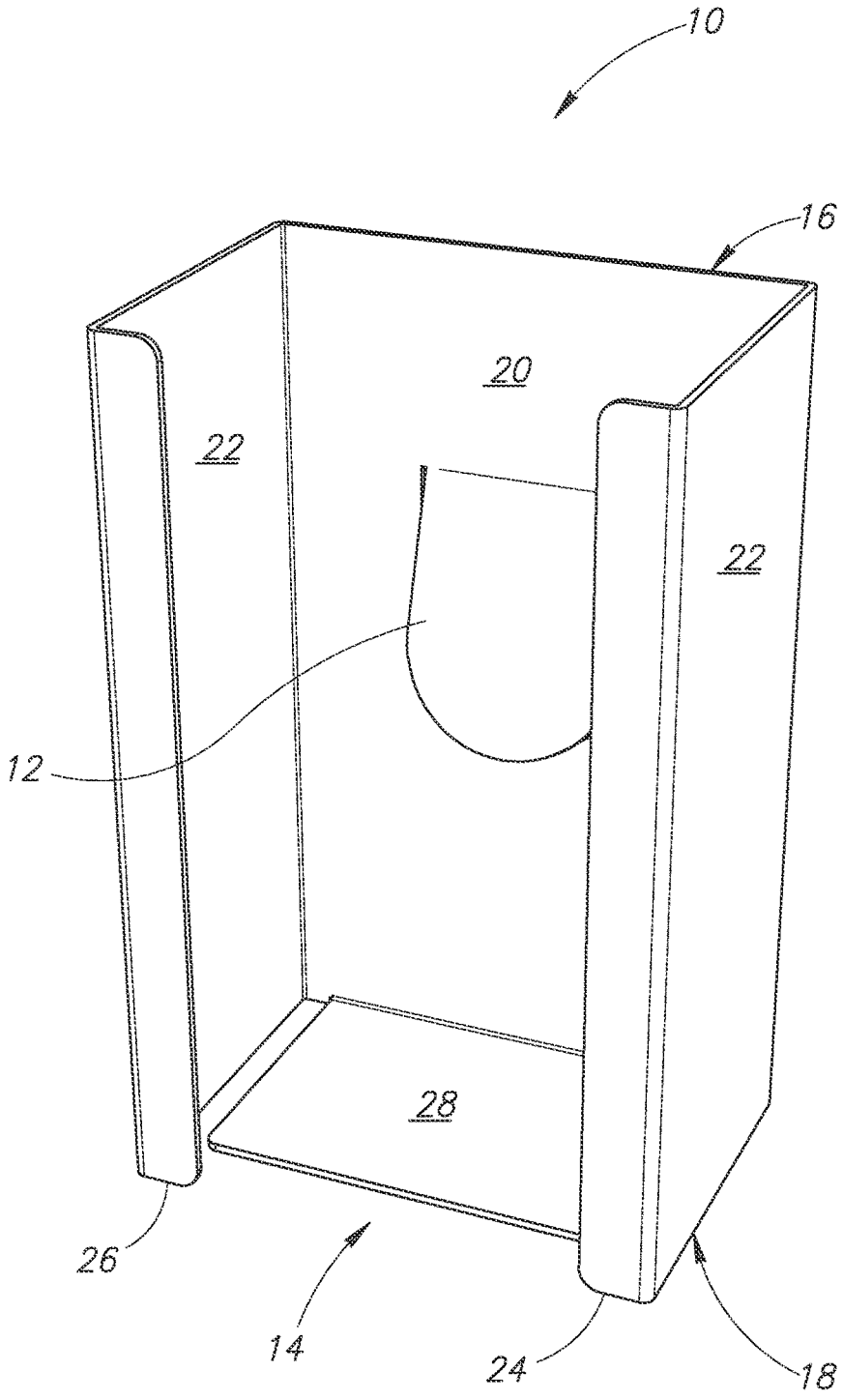
FIG.1 (PRIOR ART)
FIG. 1 is a top, front, right isometric view showing a prior-art dispenser.

The fully open, front aperture and the rigid back plate concept of the conventional dispenser 10, described above with reference to FIG. 1, leaves the conventional dispenser 10 vulnerable to side load flexing, especially when the conventional dispenser 10 is made from a relatively flexible material such as, but not limited to, a plastic material, a thin, metal material, a thin composite material, etc. As mentioned, the spring mechanism 12 urges the consumables box (not shown) forward, which places an outward force on the front plates 24, 26. In addition, pulling consumable products from the consumables box also places a dynamic, outward force on the front plates 24, 26. Often times, the application of one or both of these forces causes the front plates 24, 26 to displace or bend outward to such an extent that the consumables box falls out of the conventional dispenser 10. If spring mechanisms, such as spring mechanism 12, are added to the side plates 22 then the displacement or bending phenomena of the front plates 24, 26 may be even more pronounced.

Figure 2:
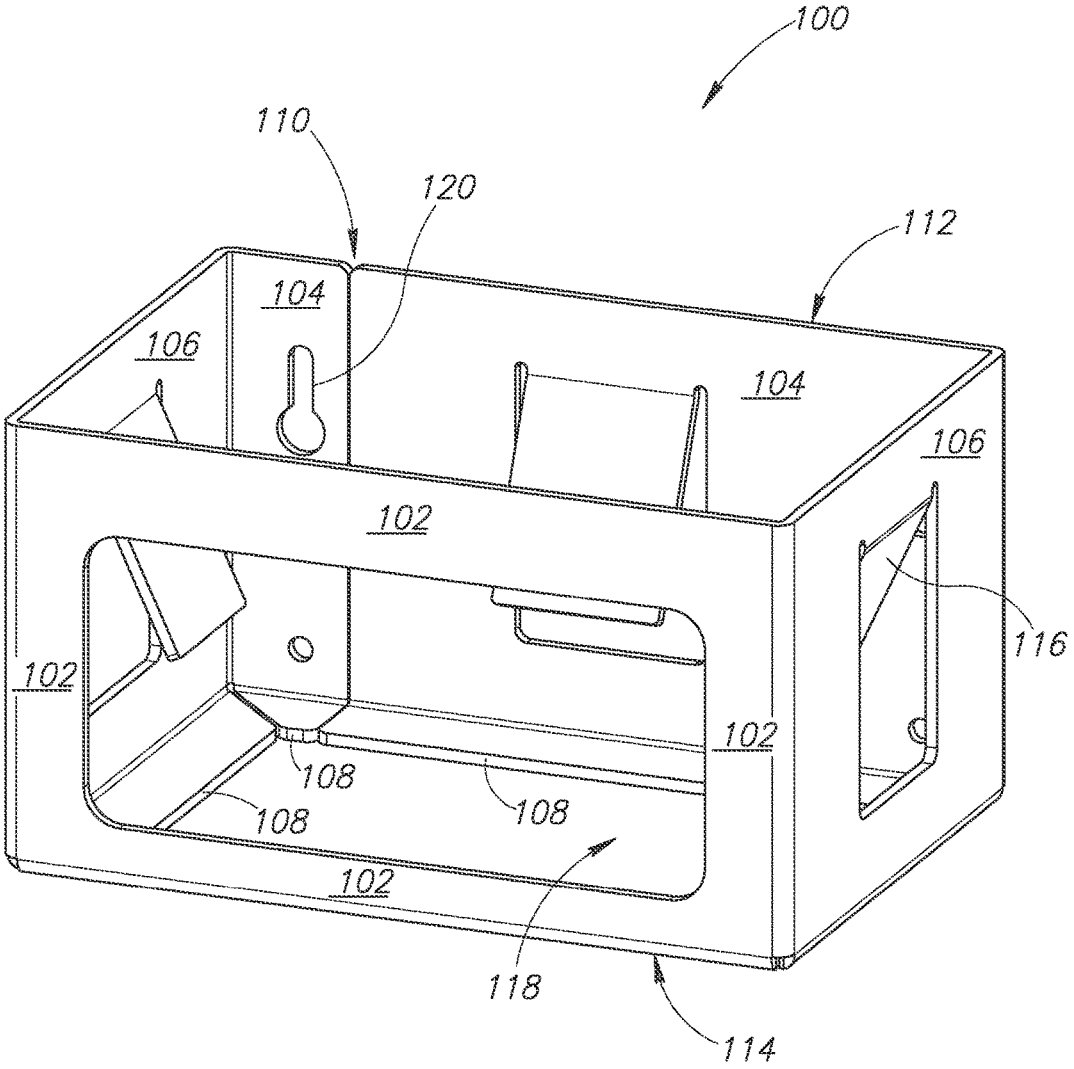
FIG. 2 is a top, front, right isometric view showing a dispenser having a continuous front plate according to an embodiment of the present invention.
Figure 3:
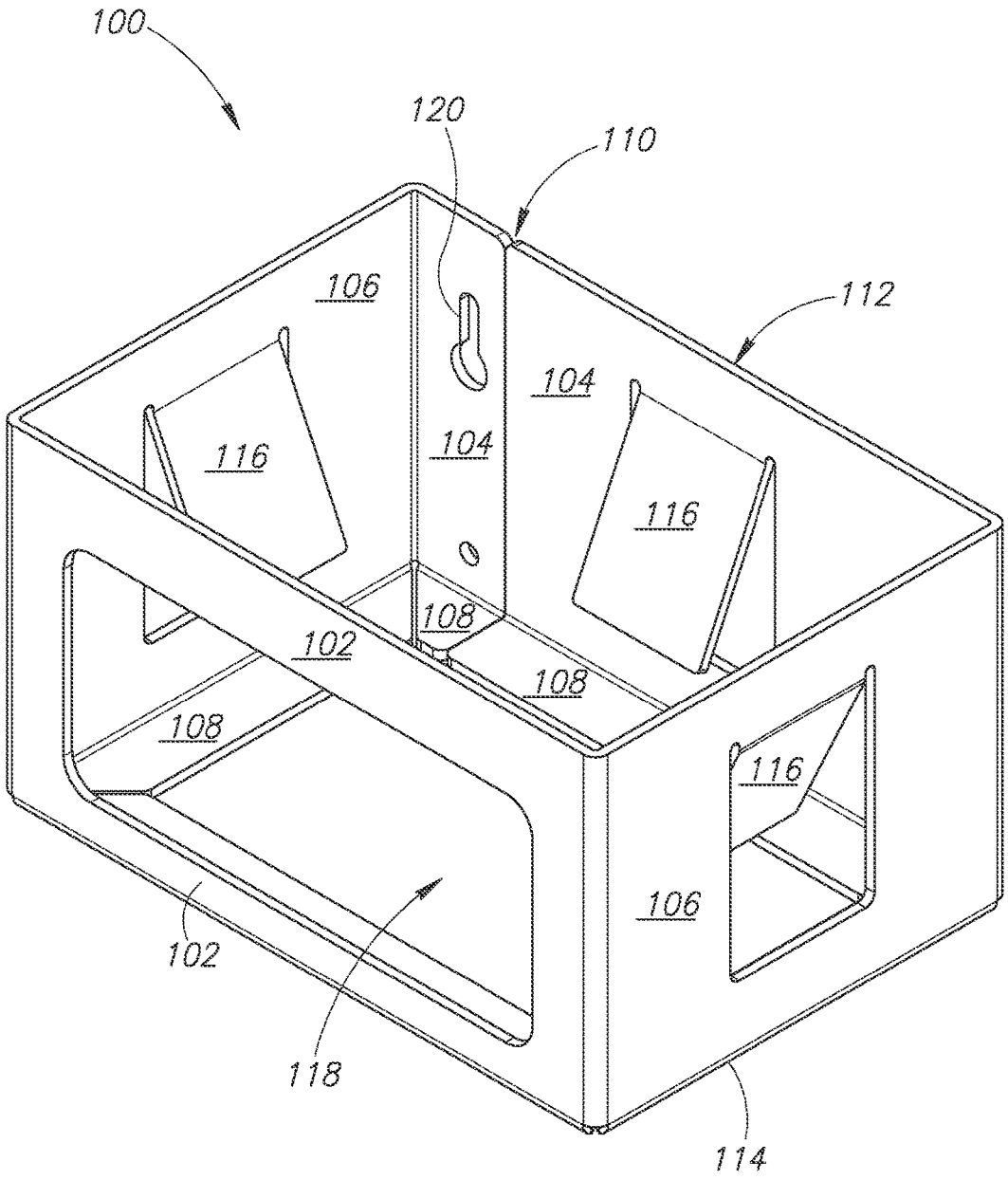
FIG. 3 is a top, front, right perspective view showing the dispenser of FIG. 2.
Figure 4:
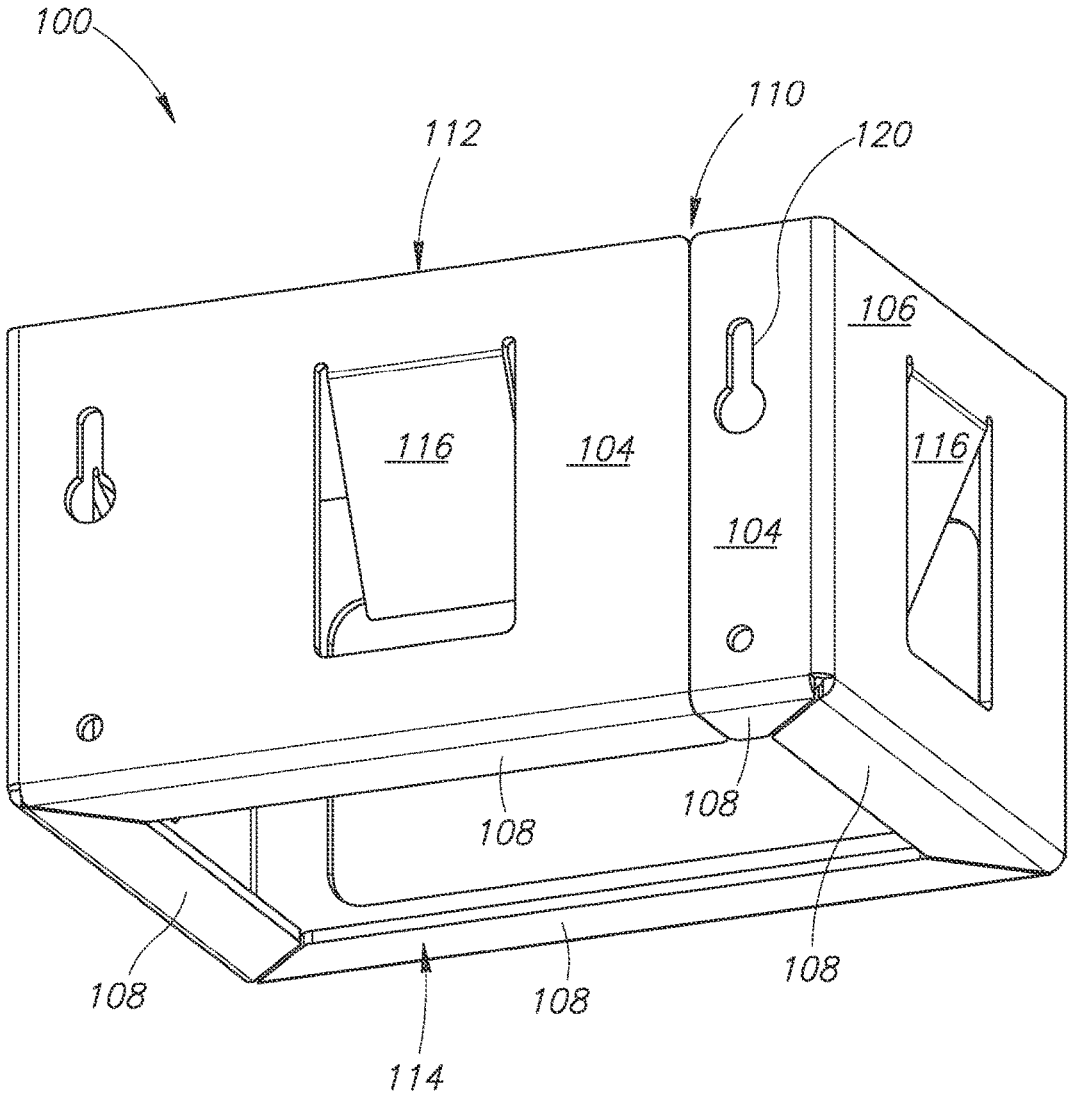
FIG. 4 is a bottom, left perspective view showing the dispenser of FIG. 2.

FIGS. 2-4 show a dispenser 100 having a continuous front plate 102 and separable back plates 104 according to an embodiment of the present invention. The dispenser 100 may be produced or otherwise formed from a single piece of material, which may take the form of a flat sheet before being shaped into the dispenser 100. The dispenser 100 also includes continuous side plates 106 and a plurality of bottom shelves 108 for supporting a consumables box (not shown) holding consumable products.

The separable back plate 104 is separable along a cut 110 that extends through a wall thickness of the separable back plates 104 and further extends from a top edge or surface 112 of the dispenser 100 to a bottom edge or surface 114 of the dispenser 100. The cut 110 may take the form of a vertical, straight-line cut or and alternate-shaped cut extending through the dispenser 100 as previously described herein. The cut 110 permits the dispenser 100 to be flexible before mounting to a wall or other structure (not shown).

Further, the separable back plates 104 and one or more of the continuous side plates 106 may include spring mechanisms 116 in the form of integrated, angled flanges for maintaining the consumables box in a centered and forward position. The spring mechanisms 116 allow for easy extraction of the consumable products. Preferably, the spring mechanisms 116 are made of the same material as the dispenser 100. The spring mechanisms 116 may be all be the same size or may be different sizes depending on an amount of force to be applied to the consumables box in a certain direction.

The continuous front plate 102 forms an aperture 118 that permits access to the consumable products held in the consumables box (not shown). When the dispenser is mounted to a wall or other structure (not shown) using one or more mounting apertures 120, the separable back plates 104 may be placed in abutment contact along the cut 110. The mounting process advantageously allows the overall stiffness of the dispenser to be developed. Stated otherwise, an outward force applied to the continuous front plate 102, after the dispenser 100 has been mounted to a wall or other structure, would be transferred from the continuous front plate 102, then into the continuous side plates 106, then into the separable back plates 104, into mounting hardware (not shown) placed in the mounting apertures 102, and finally into the wall or other structure. Consequently, the continuous front plate 102 would not permit the consumables box to displace or bend the continuous front plate 102 to an extent where the consumables box could fall out of the dispenser 100. The mounted dispenser 100 eliminates or sufficiently reduces undesired flexing of the dispenser 100 because of the continuous front plate 102 and eliminates or sufficiently reduces undesired movement of the consumables box held within the dispenser 100.

Figure 5:
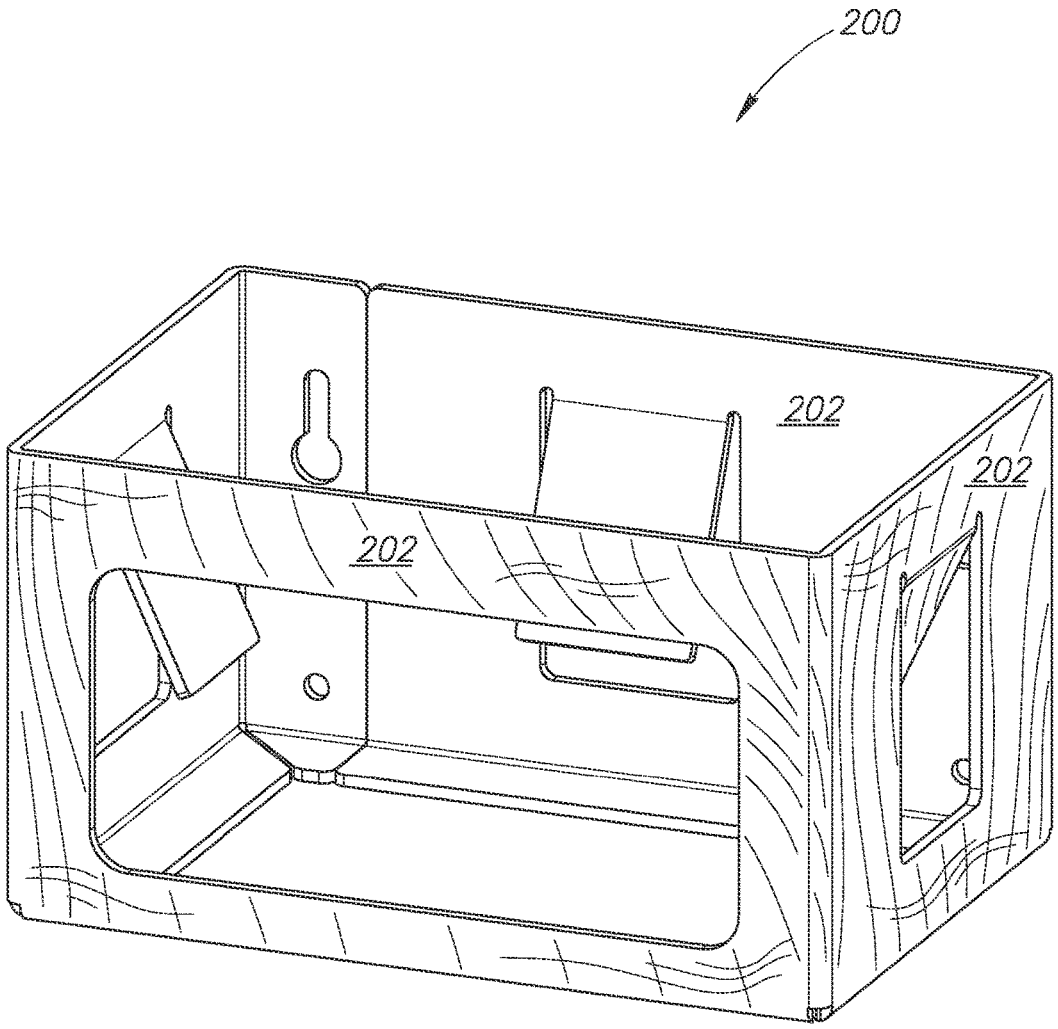
FIG. 5 is a top, front, right isometric view showing a dispenser having a woodgrain laminate according to an embodiment of the present invention.

In another embodiment, FIG. 5 shows a dispenser 200 having an aesthetic, woodgrain surface 202 that may be desirable by a variety of industries that utilize dispensers. By way of example, the healthcare industry has become more focused on comfort care for patients. The healthcare industry has started to place a higher emphasis on developing a warmer environment within patient waiting areas and exam rooms, as contrasted to the cold, metallic environments of the past. Real wood and other open-cell surfaces are generally not used on furniture, cabinetry and equipment where infection or communicable illness may be transmitted. Conventional dispensers, as noted above, are made from materials such as, but not limited to, non-finished plastics, powder coated metals, and stainless steel.

In the illustrated embodiment, the woodgrain surface may take the form of a woodgrain laminate applied onto at least a visible surface of the dispenser 200 before forming. Preferably, the woodgrain laminate would be made from a closed-cell plastic material, but could be made from other materials depending on an end-customer's needs for the dispenser 200. The type, style and color of the woodgrain laminate may be selected by the end-customer (e.g., a cherry wood laminate or a pine wood laminate). In another embodiment, both the visible and non-visible surfaces of the dispenser 200 may include woodgrain surfaces 202 covered with the woodgrain laminate.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of dispensers, organizers and methods of making the same that operate in accordance with the claims. Accordingly, the invention is not limited by the disclosure, but instead its scope is to be determined entirely by the following claims

The invention claimed is:

1. A dispenser adapted to be mounted to a wall for dispensing consumables contained in a consumables box, the dispenser comprising:

a front plate having an aperture configured to allow the consumables to be extracted from the consumables box, where the front plate extends completely around the aperture;

first and second side plates integrally formed with the front plate;

first and second back plates, where the first back plate is integrally formed with the first side plate, the second back plate is integrally formed with the second side plate, the first and second back plates are separated by a cut that extends completely through a thickness of the back plates and further extends from a top edge to a bottom edge of the back plates such that the first and second back plates are moveable relative to one another prior to attachment of the dispenser to the wall, the first and second back plates are adapted to be secured to the wall, where the first and second back plates are fixed relative to each other when the first and second back plates are secured to the wall, a back spring mechanism integrally formed with the first back plate;

at least one side spring mechanism integrally formed with at least one of the first and second side plates; and at least one bottom shelf integrally formed with at least one of the front plate, the first and second side plates, and the first back plate; wherein;

when the first and second back plates are secured to the wall and the at least one consumables box is supported by the at least one bottom shelf, the back spring mechanism applies a force on the consumables box such that the consumables box applies a first outward force on the front plate;

the at least one side spring mechanism applies a force on the consumables box such that the consumables box applies a second outward force on the first and second side plates;

the first and second outward forces are transmitted to the wall through the first and second side plates and the first and second back plates; and the front plate is sized and dimensioned to reduce flexing of the dispenser when the first and second outward forces are applied thereto to reduce or eliminate movement of the consumables box held by the dispenser.

2. The dispenser of claim 1, the back spring mechanism is an angled flange integrally formed in the first back plate.

3. The dispenser of claim 1, further comprising first and second side spring mechanisms extending from the first and second side plates, respectively.

4. The dispenser of claim 3, in which the at least one side spring mechanism is an angled flange integrally formed in at least one of the first and second side plates.

5. The dispenser of claim 4, in which one of the first and second side plates surrounds each side spring mechanism.

6. The dispenser of claim 1, wherein the back plates include a plurality of mounting apertures.

7. The dispenser of claim 1, wherein the dispenser is made from a single piece of material.

8. The dispenser of claim 7, wherein the single piece of material takes a preformed shape of a flat sheet.

9. The dispenser of claim 1, wherein the at least one bottom shelf is integrally formed with at least one of the first and second back plates, the first and second side plates, and the front plate.

10. The dispenser of claim 1, wherein the cut is a straight-line cut.

11. The dispenser of claim 10, wherein the straight-line cut extends vertically.

12. The dispenser of claim 1, wherein the cut is a non-straight-line cut.

13. The dispenser of claim 1, in which the first back plate surrounds the back spring mechanism.

14. The dispenser of claim 1, further comprising first and second side spring mechanisms extending from the first and second side plates, respectively, wherein the first and second side spring mechanisms are configured to urge the consumables box into a centered position within the dispenser.

15. The dispenser of claim 14, in which one of the first and second side plates surround the first and second side spring mechanisms, respectively.

16. The dispenser of claim 14, in which the first and second side spring mechanisms are integrated, angled flanges formed in the first and second side plates, respectively.

17. The dispenser of claim 1, wherein the at least one bottom shelf is integrally formed with at least one of the first and second back plates, the first and second side plates, and the front plate.

18. The dispenser of claim 1, wherein the at least one bottom shelf comprises a back bottom shelf integrally formed with the first back plate, first and second side bottom shelves integrally formed with the first and second side plates, respectively, and a front bottom shelf integrally formed with the front plate.

* * * * *